US005497138A

United States Patent [19]

Malpiece et al.

[11] Patent Number: 5,497,138

[45] Date of Patent: Mar. 5, 1996

[54] VARISTOR SURGE ARRESTORS, IN PARTICULAR FOR HIGH TENSION

[75] Inventors: Frédéric Malpiece, Bagneres de Bigorre; Alain Rousseau, Orignac; Dominique Mercier, Billere, all of France

[73] Assignee: Soule, Bagneres de Bigorre, France

[21] Appl. No.: 157,383

[22] Filed: Nov. 23, 1993

[30] Foreign Application Priority Data

Nov. 27, 1992 [FR] France ..... 92 14303

[51] Int. Cl.[6] ..... H01C 7/10

[52] U.S. Cl. ..... 338/21; 361/117

[58] Field of Search ..... 338/13, 14, 15, 338/20, 21; 361/117, 126–128

[56] References Cited

U.S. PATENT DOCUMENTS

| | | | |
|---|---|---|---|
| 1,497,978 | 6/1924 | Jacobs | 338/21 |
| 2,276,732 | 3/1942 | Ludwig et al. | 338/21 |
| 3,227,983 | 1/1966 | Braun | 338/21 |
| 4,825,188 | 4/1989 | Parraud et al. | 338/21 |
| 4,833,438 | 5/1989 | Parraud et al. | 338/21 |
| 4,853,670 | 8/1989 | Stengard | 338/21 |
| 4,940,961 | 7/1990 | Thuries et al. | 338/21 |

*Primary Examiner*—Tu Hoang

*Attorney, Agent, or Firm*—Blakely, Sokoloff, Taylor & Zafman

[57] ABSTRACT

A method of manufacturing a surge arrestor, comprising the following steps: making a stack of varistors and forming a first envelope that is at least semi-rigid thereon and that has an outside section that is constant along its length, thereby serving in particular to compensate for surface irregularities in the stack of varistors due to alignment faults and to dimensional dispersions in the varistors, after which an outer envelope of substantially constant thickness is extruded on the first envelope, and then annular fins are installed on the extruded outer envelope. A surge arrestor, comprising a stack of varistors, a first envelope surrounding the stack of varistors that is at least semi-rigid thereon and that has an outside section that is constant along its length, thereby serving in particular to compensate for surface irregularities in the stack of varistors due to alignment faults and to dimensional dispersions in the varistors, an outer envelope of substantially constant thickness extruded on the first envelope, and annular fins installed on the extruded outer envelope.

39 Claims, 4 Drawing Sheets

VARISTOR SURGE ARRESTORS, IN PARTICULAR FOR HIGH TENSION

FIELD OF THE INVENTION

The present invention relates to the field of surge arrestors.

It is particularly applicable to surge arrestors for high tension, typically in electricity distribution networks having a nominal voltage that is greater than 1 kV rms between phases.

BACKGROUND OF THE INVENTION

Surge arrestors are devices that are designed to be connected between an electricity line, in particular a medium or high tension line, and ground, for the purpose of limiting the amplitude and the duration of surges that appear on the line.

These surges may be due, for example, to atmospheric phenomena, such as lightning, or to induction in the conductors.

Such surges may also be due to switching operations performed on a line while under tension.

Surge arrestors are generally in the form of a stack of various varistors, and nowadays generally a stack of several disks based on zinc oxide which has electrical resistivity that is highly non-linear as a function of the applied voltage.

More precisely, such varistors allow practically no current to pass so long as the voltage across their terminals remains below a trigger threshold, and in contrast, they pass a very large current that may reach several tens of kA, when the voltage applied across their terminals exceeds the above-mentioned trigger threshold.

The number of varistors used in a surge arrestor is chosen so that the nominal operating voltage on an electricity line is less than the trigger threshold across the terminals of the stack of varistors.

Thus, the surge arrestor can continuously withstand the nominal operating voltage without any current leaking away, while also serving to carry very high discharge currents that may appear temporarily on a line in the event of an accidental voltage surge.

Numerous types of surge arrestor have already been proposed.

The field of surge arrestors has given rise to a literature that is very abundant.

Presently known surge arrestors generally comprise:

a stack of varistors;

two contact pieces of electrically conductive material placed at respective ends of the stack of varistors; and an envelope of electrically insulative material surrounding the stack of varistors.

The above-mentioned envelope of electrically insulative material is itself the subject of literature that is very abundant.

Document GB-A-2 073 965, for example, proposes making said envelope out of a heat-shrinkable material.

Documents U.S. Pat. No. 4,298,900, DE-A-3 001 943, and DE-A-3 002 014 propose additionally installing a porcelain outer housing over the heat-shrinkable envelope.

Documents U.S. Pat. No. 4,092,694 and U.S. Pat. No. 4,100,588 propose placing each varistor in a ring based on silicone and of disposing the stack of varistors surrounded in this way in a porcelain housing.

Document U.S. Pat. No. 2,050,334 proposes placing a stack of varistors in a porcelain housing and of filling the space between the porcelain housing and the stack of varistors with a filler material that is formed, for example, of a halogen-containing compound based on wax.

Documents EP-A-0 008 181, EP-A-0 274 674, EP-A-0 281 945, and U.S. Pat. No. 4,456,942 propose making an envelope surrounding the varistors by means of an elastomer material, in particular formed by being overmolded on the varistors.

More precisely, document EP-A-0 274 674 proposes overmolding an envelope made of a composite material based on elastomer, EPDM, silicone, or any other filled or unfilled resin on a stack of varistors.

Document U.S. Pat. No. 4,161,012 also proposes placing an elastomer envelope on varistors. That document proposes making the envelope by depositing the elastomer on the outside surfaces of the varistors or by molding the envelope onto the varistors, or else by preforming an envelope out of elastomer and then inserting the varistors therein.

As early as 1958, document U.S. Pat. No. 3,018,406 proposed making the envelope in the form of two complementary preformed shells together with an outer envelope of a plastics material that is injection-molded over the varistors.

Document U.S. Pat. No. 3,586,934 proposes making the envelope by means of a synthetic resin, e.g. based on an epoxy or a polyester resin, or else on a polyester or silicone varnish.

Document EP-A-0 196 370 proposes making the envelope on a body of varistors by casting a synthetic resin, formed by epoxy resin, polymer concrete, silicone resin, or an elastomer, or by covering the body of varistors in a tube of heat-shrinkable plastics material, or else by providing said stack with a layer of synthetic resin.

Furthermore, the following documents: U.S. Pat. Nos. 4,656,555, 4,905,118, 4,404,614, EP-A-0 304 690, EP-A-0 335 479, EP-A-0 335 480, EP-A-0 397 163, EP-A-0 233 022, EP-A-0 443 286, and DE-A-0 898 603 propose making the envelope surrounding the stack of varistors out of composite materials comprising fibers, generally glass fibers, impregnated in resin.

More particularly, document U.S. Pat. No. 4,656,555 proposes initially forming a winding of fibers based on a plastics material such as polyethylene or on glass, or on a ceramic, which fibers are optionally impregnated in resin, e.g. epoxy resin, and then forming a housing on the outside of said winding, the housing being made of a polymer material that withstands bad weather, e.g. a material based on elastomer polymers, on synthetic rubber, on thermoplastic elastomers, or on EPDM.

More precisely, that document proposes either preforming the weather-resistant polymer housing, and then engaging the stack of varistors fitted with its fiber winding in said housing, or else initially forming the winding of fibers on the stack of varistors, and then making the housing of weather-resistant polymer material by molding directly on the winding, by spraying the polymer on the winding, or by inserting the stack of varistors together with its winding in a bath of polymer.

Document U.S. Pat. No. 4,404,614 proposes placing successively on a stack of varistors a first envelope based on glass fibers impregnated with resin, e.g. epoxy resin, then a second envelope based on glass flakes and on epoxy resin, and finally a resilient outer envelope based on EPDM rubber or on butyl rubber.

That document specifies that the first envelope, the second envelope, and the outer envelope may be put into place successively on the stack of varistors, or else the envelopes may be formed in the opposite order.

That document also mentions the possibility of molding the outer envelope on the second envelope based on glass flakes and on epoxy resin.

Document EP-A-0 233 022 proposes forming a shell on a stack of varistors, the shell being based on glass fibers reinforced by epoxy resin, and then in placing on said shell an envelope that is based on elastomer and that can be heat-shrunk or that can be released thereon by equivalent mechanical means.

In a variant, the envelope may be molded in situ using a synthetic resin or a polymer material.

That document specifies that the shell may be preformed. That document also proposes using a sheet of preimpregnated fibers.

Document EP-A-0 304 690 proposes initially forming a filamentary winding of resin-impregnated glass fibers, and then in forming a coating of EPDM type elastomer material on the outside of the winding by injection.

Document EP-A-0 355 479 proposes placing the following in succession on the stack of varistors: firstly a barrier formed by a plastics film, e.g. based on propylene; then a winding of non-conductive filaments; and finally a weather-resistant elastomer housing.

Document EP-A-0 397 163 proposes placing the following in succession on the stack of varistors: a winding of filaments impregnated with resin; and then forming a coating having fins on said winding, the coating being made of elastomer, e.g. EPDM, and being formed by injection.

The technique of using a composite material is very old.

As early as 1946, document DE-A-0 898 603 had proposed using resin-impregnated glass fibers for enveloping varistors.

The surge arrestors proposed heretofore have given good service.

Nevertheless, the Applicant seeks to improve existing surge arrestors.

OBJECTS AND SUMMARY OF THE INVENTION

A main object of the present invention is to improve the reliability of existing surge arrestors, in particular by avoiding the presence of any air at the interface(s) between the stack of varistors and the envelope covering the stack.

A subsidiary object of the present invention is to reduce the size, the weight, and the cost of known surge arrestors.

To this end, the present invention provides a method of making a surge arrestor of the type comprising the following steps:

i) stacking varistors;

ii) forming a first envelope of composite material on the stack of varistors; and iii) placing an outer envelope having fins on the first envelope made of composite material;

the method being characterized by the facts that:

step ii) consists in making a first envelope that is at least semi-rigid and that has constant outside section over its entire length, serving in particular to compensate for surface non-uniformities in the stack of varistors due to alignment errors and to dispersions in the dimensions of the varistors; and step iii) consists in:

a) initially extruding an outer envelope of substantially constant thickness over the first envelope; and then b) fitting annular fins to the extruded outer envelope.

As explained below, by making the outer envelope by extrusion, it is possible to expel all of the air from the interface between the first envelope of composite material and the outer envelope.

The present invention also relates to the product obtained by implementing the method.

According to the invention, the resulting surge arrestor comprises:

a stack of varistors;

a first envelope of composite material formed on the stack of varistors; and a finned outer envelope placed on the first envelope made of composite material.

More precisely, this surge arrestor of the present invention is characterized by the facts that:

the first envelope is at least semi-rigid and is constant in outside section over its length, serving in particular to compensate for surface non-uniformities in the stack of varistors due to defects of alignment and to dispersions in the dimensions of the varistors; and the finned outer envelope comprises firstly an outer envelope of substantially constant thickness formed by extrusion on the first envelope, and secondly annular fins subsequently installed on the extruded outer envelope.

BRIEF DESCRIPTION OF THE DRAWINGS

Other characteristics, objects, and advantages of the present invention appear on reading the following detailed description given with reference to the accompanying drawings showing non-limiting examples, and in which.

accompanying

MORE DETAILED DESCRIPTION

Figure 1:
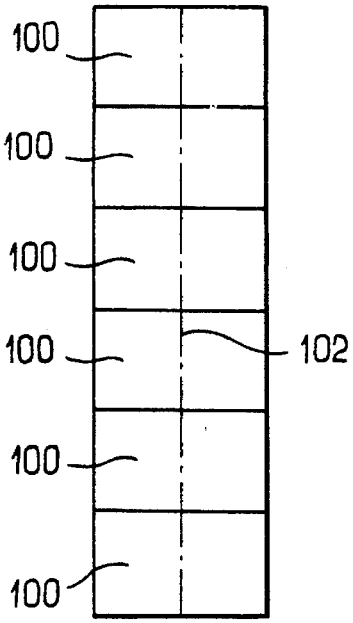
FIGS. 1 to 6 are diagrams in axial longitudinal section through a surge arrestor showing various successive steps in making a surge arrestor constituting a variant embodiment of the present invention.

The surge arrestor of the present invention as shown in accompanying FIG. 6 and as obtained by the intermediate steps shown in FIGS. 1 to 5 which are described below, comprises a stack of varistors 100, two contact pieces 200, a first envelope 300 of composite material, an extruded outer envelope 400, attached fins 500, and additional sealing means 600.

Figure 8:
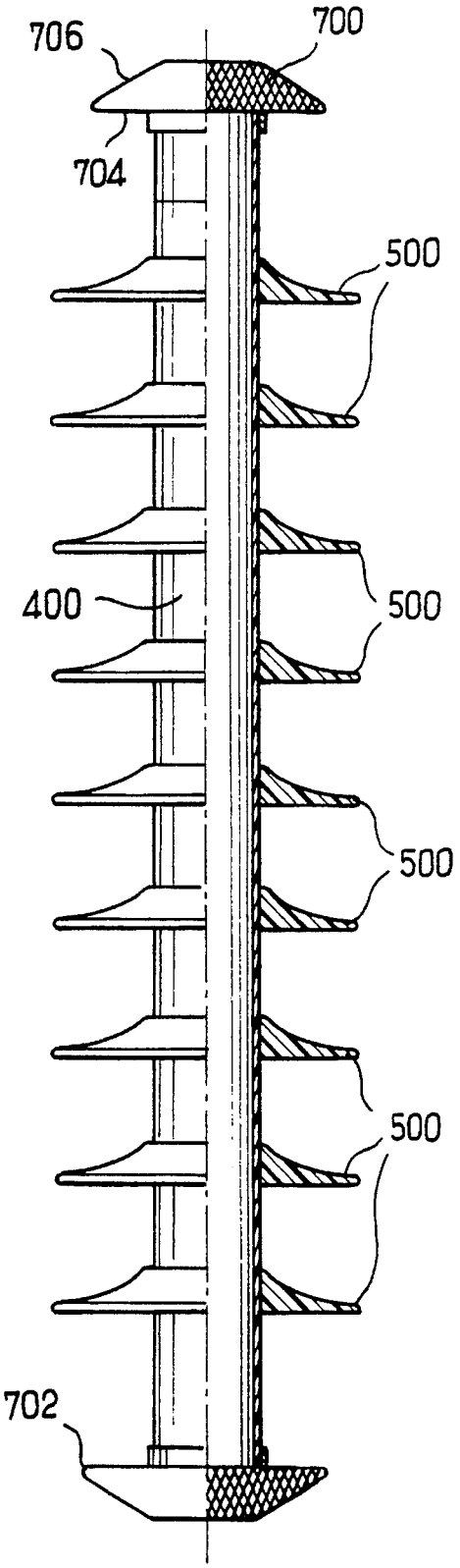
FIG. 8 is a diagram showing a variant embodiment of a surge arrestor of the present invention, and more precisely the lefthand half-section of FIG. 8 shows the surge arrestor as seen from the outside, while the righthand half-view of FIG. 8 shows the same surge arrestor in longitudinal axial section.

The surge arrestor preferably also includes, as shown in FIG. 8, two end caps 700 of electrically conductive material.

The varistors 100 are in the form of constant diameter disks made on the basis of zinc oxide.

Zinc oxide based varistors are well known to the person skilled in the art.

The method of making them and their composition are therefore not described below.

As shown in accompanying FIG. 1, the varistors 100 are initially stacked along their axis 102 so that their axes coincide accurately.

Although not shown in accompanying FIG. 1, spacers of electrically conductive material, e.g. in the form of disks, or even including resilient members, may be interposed, where appropriate, between at least some adjacent pairs of varistors 100.

Figure 2:
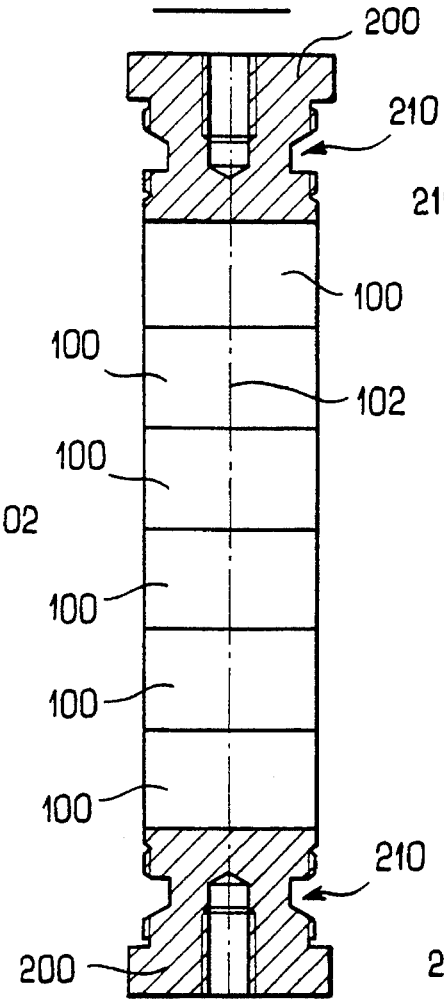

As shown in FIG. 2, once the stack has been made, the two contact pieces 200 are preferably placed at respective ends of the stack of varistors.

Nevertheless, in a variant, it is possible to envisage placing the contact pieces 200 on the ends of the surge arrestor only after the first envelope 300 has been made, or even only after the outer envelope 400 has been made.

The shape of a particular and non-limiting embodiment of the contact pieces 200 is described in greater detail below with reference to FIGS. 9 and 10.

At present, it should merely be observed that the contact pieces 200 preferably include respective annular grooves 210.

Figure 3:
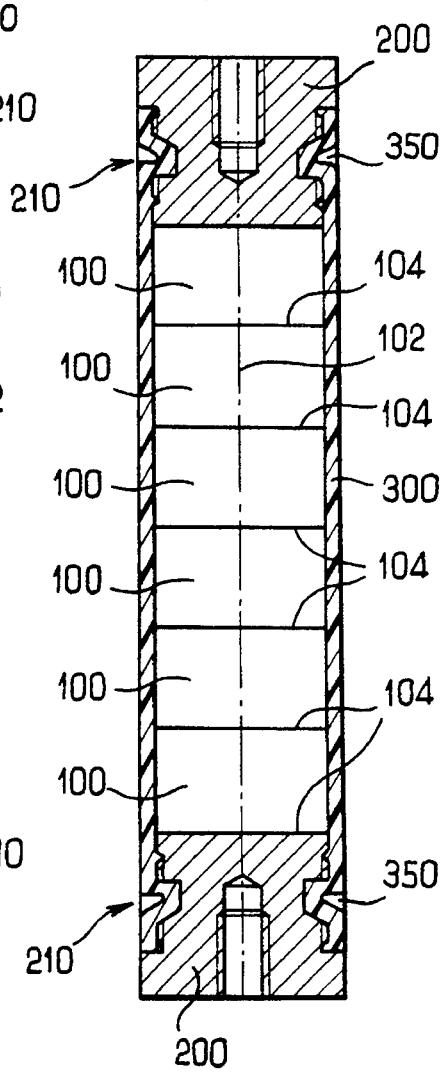

As shown diagrammatically in FIG. 3, the subsequent step in the method of the present invention consists in forming a first envelope 300 of composite material on the stack of varistors 100 formed in this way.

For this purpose, a cloth of fibers 300, most preferably glass fibers, is preferably wound around the stack of varistors 100 and over the respective bases of the two contact pieces 200.

Two bands 350 are clamped around the envelope 300 over the above-mentioned grooves 210.

The envelope 300 thus provides a secure link between the two contact pieces 200 and, by applying axial thrust, it maintains good electrical contact not only between the main faces 104 extending transversely to the axis 102 of each pair of adjacent varistors, but also between the outermost end faces 104 of the varistors 100 placed at the ends of the stack and respective ones of the contact pieces 200.

In a highly preferred, but non-limiting embodiment of the present invention, and as mentioned above, the envelope 300 is made of a fiber cloth.

The fibers are preferably glass fibers.

These fibers extend essentially parallel to the axis 102 of the stack of varistors.

In addition, the fibers advantageously extend along the entire length of the stack.

Thus, when a force is applied transversely to the axis 102 on one of the ends of the surge arrestor, the fibers of the envelope 300 are subject either to elongation or to compression.

Glass fibers have excellent strength characteristics both in elongation and in compression.

Consequently, they enable the surge arrestor to have good mechanical strength in bending.

More precisely, the fiber cloth used is advantageously an open-mesh cloth. This disposition makes it possible for the stack of varistors to degas freely.

The fiber cloth may be impregnated by any resin known to the person skilled in the art in the field of composite materials.

The bands 350 may be made in numerous different ways, e.g. in the form of respective tapes, or in the form of separate fibers such as resin-impregnated fibers.

By installing the bands 350, the envelope 300 is locked in place against translation on each of the contact pieces 200, thereby ensuring that the contact pieces 200 are themselves locked against relative translation motion.

The envelope 300 may be made of several sheets of superposed fibers.

An outermost sheet of fibers may be wound, where applicable, over the entire preformed envelope 300 together with the bands 350 so as to define a continuous and uninterrupted cylindrical outside surface prior to making the outer envelope 400.

For the extrusion step shown diagrammatically in FIG. 2 it is essential for the outer surface of the inner envelope 300 to have a smooth surface state and to be accurately constant in section over its entire length.

The thickness of the inner envelope 300 must, as mentioned above, be adapted to compensate, in particular for surface non-uniformities in the stack of varistors due to failures of alignment and to dispersion in the dimensions of the varistors.

In a highly preferred implementation of the present invention, the fiber cloth constituting the envelope 300 comprises crossed glass fibers having 62.5% by weight of fibers in the weft direction parallel to the axis 102, and 37.5% by weight of the fibers in the warp direction transverse to the axis 102.

The mesh size of the cloth is 3.5 mm by 5 mm.

The crossed glass fibers are stuck together by heat.

The weft length is equal to the length of the envelope 300.

The thickness of each sheet of cloth is of the order of 1.60 mm, and it is preferable to use two or three superposed sheets of cloth.

The resin used is preferably an unsaturated polyester.

In a particular embodiment given by way of non-limiting example, the bands 350 are made of glass fibers occupying 80% by weight in the warp direction and 20% by weight in the weft direction, and they are 20 mm wide.

Figure 4:
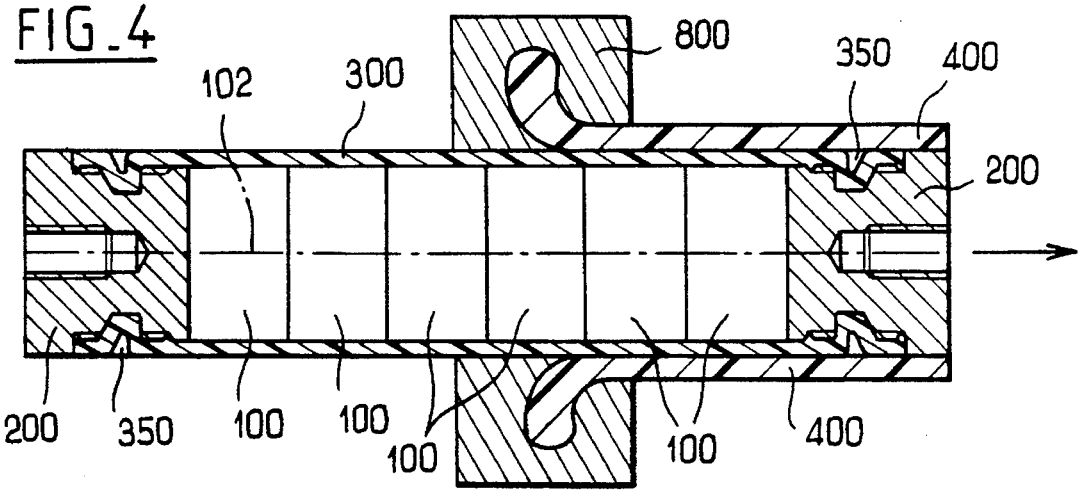

As shown diagrammatically in FIG. 4, the next step consists in engaging the resulting stack as shown in FIG. 3 and including the inner envelope 300 in an extrusion die 800 for forming the outer envelope 400.

In FIG. 4, an extrusion head 800 is shown diagrammatically.

In practice, any suitable conventional extruder may be used.

The outer envelope 400 serves essentially to protect the stack of the surge arrestor 100 and its inner envelope 300 of composite material in particular against moisture, and more generally against bad weather.

The outer envelope 400 may be made of any suitable material.

It is preferably made of a material based on silicone.

The envelope 400 is of substantially constant thickness over the entire length of the surge arrestor, and over its entire periphery.

The thickness of the outer envelope is typically at least 3 mm.

During this extrusion step, the stack comprising the varistors 100 covered in the envelope 300 of composite material may be driven and guided in translation along its own axis 102 centered on the die 800 by any appropriate means.

Figure 7:
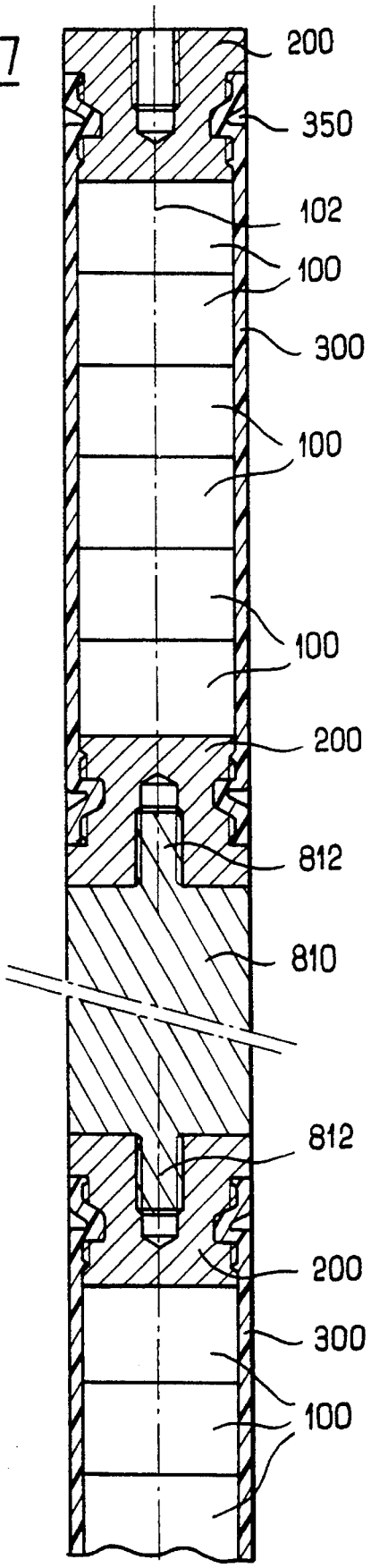
FIG. 7 is a diagrammatic view of two surge arrestor blanks that are connected to each other by a spacer to facilitate the extrusion step.

As shown diagrammatically in FIG. 7, in order to guide the stacks, it is possible to connect the stacks shown in FIG. 3 in pairs by means of intermediate bars 810 having the same outside diameter as the envelope 300 and fixed to the contact pieces 200 by means of bolts 812.

In a variant of the realization shown in FIG. 7, instead of having an intermediate bar 810 placed between a pair of stacks of the kind shown in FIG. 3, it is possible to have two equivalent bars 810 fixed to respective ones of the contact pieces 200 on the same, single stack of varistors.

Under such circumstances, the stacks are engaged successively, one by one, in the extrusion die 800, instead of being engaged as a succession in the manner made possible by the intermediate bars 810 as shown in FIG. 7.

It is preferable for a keying primary coat to be deposited on the outer surface of the envelope 300 prior to the extrusion step. Nevertheless, the keying primary coat is not placed on the bar(s) 810.

Figure 5:
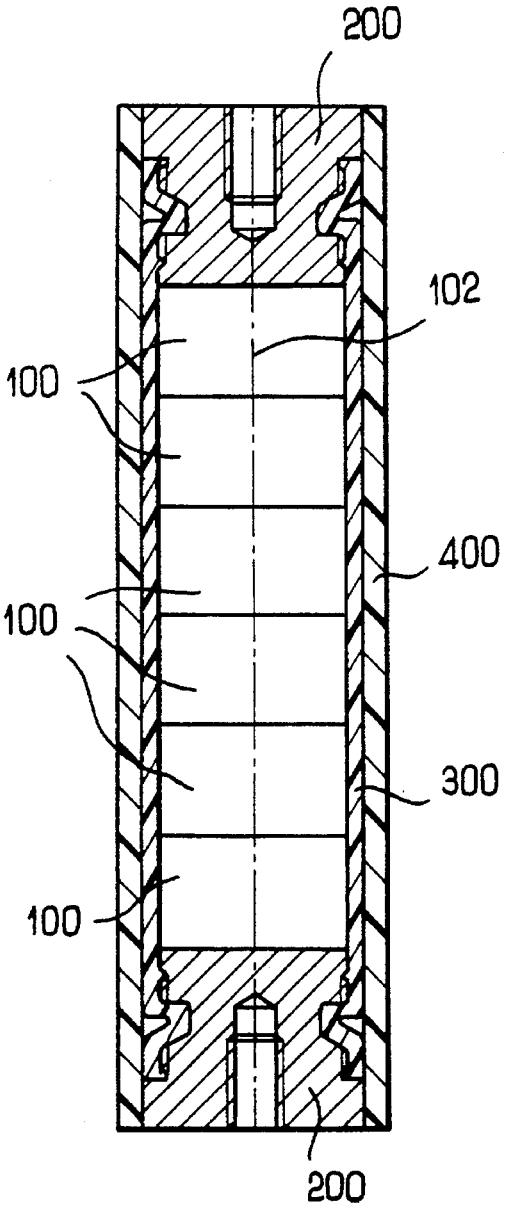

The product obtained at the outlet from the extrusion step is shown in FIG. 5.

Figure 6:
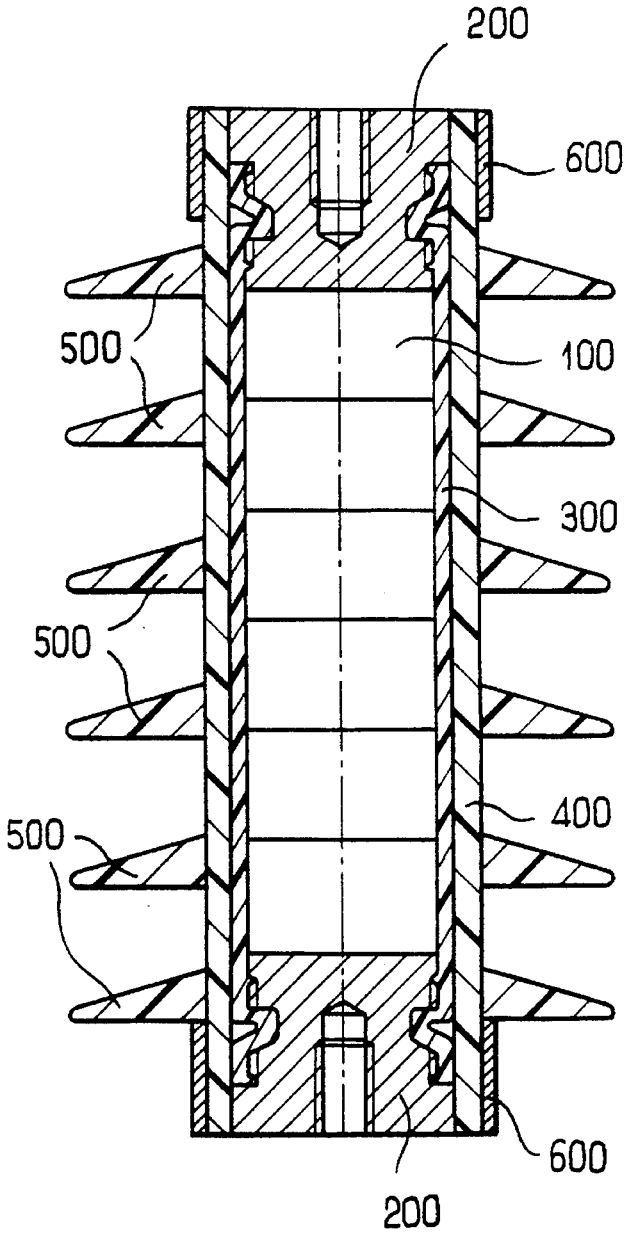

Thereafter, as shown diagrammatically in FIG. 6, it is necessary to install the fins 500 on the outer envelope 400.

It is recalled that the purpose of the fins 500 is to lengthen the creepage distance on the outside of the surge arrestor.

To this end, the fins 500 are preferably premolded and then threaded successively onto the body obtained from the extrusion step.

The number, shape, and spacing of the fins may vary as a function of the degree of resistance to pollution desired for the surge arrestor, and naturally also on its nominal voltage.

The fins 500 are preferably generally frustoconical in shape, as shown in FIG. 6.

They are advantageously based on silicone, as is the envelope 400.

The fins 500 are preferably held in place on the outer envelope 400 by adding a synthetic composition that acts as an adhesive.

On examining FIG. 6, it may also be observed that it is preferable to reinforce the moisture-tightness of the surge arrestor by means of collars 600 which are clamped on the ends of the envelope 400, engaging respective ones of the contact pieces 200.

Accompanying FIG. 8 shows an example of a surge arrestor of the present invention suitable for a network operating at 63 kV.

It may be observed in accompanying FIG. 8 that the surge arrestor further includes an electrically conductive cap 700 at each of its ends, the caps preferably being made of metal.

Each cap 700 may cover the associated collar 600, for example.

Each cap 700 may be fixed to the end of the surge arrestor by any appropriate means, e.g. by being screwed into the contact piece 200.

Each cap 700 is preferably provided with a central orifice coaxial about the axis 102, and designed to allow a bolt to pass that is associated with the corresponding contact piece 200.

In the particular embodiment shown in FIG. 8, it may be observed that the contact parts 700 which are identical in shape are each generally in the form of a truncated cone that tapers towards the outside of the surge arrestor.

The larger diameter plane face of each contact piece 700 extending perpendicularly to the axis 102 is placed against the corresponding end of the above-mentioned stack.

In addition, the larger diameter of each contact piece 700 lies between the outside diameter of the envelope 400 and the largest diameter of each of the fins 500.

Still more precisely, the larger diameter of each cap 700 is preferably equal to one-half the sum of the two above-specified diameters.

Thus, the two circular edges 702 formed where the large plane base 704 of each cap 700 meets the corresponding frustoconical surface 706 thereof serve to define a preferred arc-striking path in the event of a fault occurring at a power that is higher than can be absorbed by the stack of varistors 100.

A contact piece 200 in accordance with a particular embodiment of the present invention is now described in greater detail with reference to FIGS. 9 and 10.

The two contact pieces 200 placed at respective ends of the surge arrestor are preferably identical.

Each contact piece 200 is constituted by a single block of metal that is generally circularly symmetrical about an axis 202.

In use, the axis 202 coincides with the axis 102 of the stack of varistors.

Figure 9:
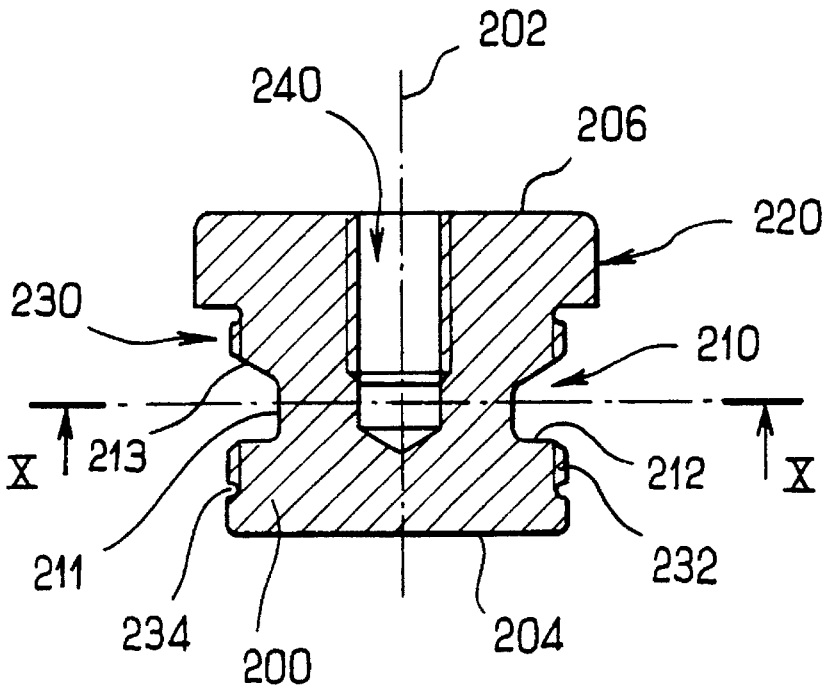
FIG. 9 is a diagrammatic longitudinal axial section through a contact piece in accordance with the present invention and in section plane referenced IX—IX in FIG. 10.

In FIG. 9, references 204 and 206 designate the main faces of a contact piece 200.

These main faces 204 and 206 are plane and orthogonal to the axis 202.

In use, the main face 204 rests against the outer main face 104 of a varistor 100 located at one of the ends of the stack.

Main face 206 faces towards the outside of the surge arrestor.

Contact piece 200 includes a cylindrical portion 202 adjacent to its main face 206 and extending towards main face 204 by means of a smaller-section shank 230.

The section of the shank 230 is preferably equal to the outside section of the varistors 100.

Thus, when the contact pieces 200 are placed on the stack of varistors 100, the shank 230 extends the outside surface of the stack.

The above-mentioned annular groove 210 is formed in the shank 230, and substantially halfway therealong.

Figure 10:
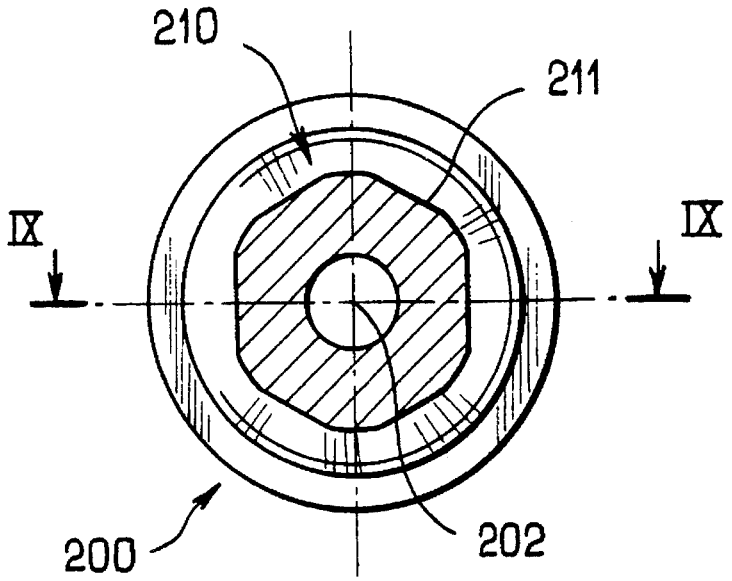
FIG. 10 is a cross-section view through the same contact piece on a section plane referenced X—X in FIG. 9.

The bottom 211 of the groove 210 is preferably polygonal in section, e.g. hexagonal in section, as shown in FIG. 10.

The first flank 212 of the groove 210 placed adjacent to the main face 204 is preferably plane and perpendicular to the axis 202.

The second flank 213 of the groove 210 placed adjacent to the main face 206 is preferably conical about the axis 202 and flaring towards the main face 206.

In addition, two helical threads 232 are formed on the outside surface of the shank 230.

The threads 232 preferably extend on either side of the groove 210.

However, the threads 232 are advantageously interrupted before reaching the main face 204.

The end of the threads 232 adjacent to the main face 204 is constituted by a small annular groove 234.

Finally, each contact piece 200 has a blind tapped bore 240 centered on the axis 202 and opening out to the main face 206.

The tapped bore 240 is designed to receive a coupling bolt as described above.

The polygonal bottom 211 of the groove 210 and the threads 232 form structures that are not circularly symmetrical about the axis 202.

These structures engage the envelope 300 and prevent any relative rotation between the contact pieces 200 and the envelope 300.

In addition, the annular grooves 210 which receive the ends of the sheet of cloth forming the envelope 300 make it possible to provide fastening between said envelope 300 and each of the contact pieces 200 that is stable in translation.

In conclusion, the structure described above and shown in the accompanying figures makes it possible to obtain a surge arrestor with good strength in bending and in rotation about the axis 102 of the stack, and in relative translation along said axis.

Where appropriate, it is possible to envisage a variant in which zones of weakness are formed in the outer envelope 400 during the extrusion step shown diagrammatically in FIG. 4, e.g. by using glass fibers that are subsequently removed.

In a variant, the surge arrestor of the present invention may be fitted with a fault-indicator device.

The device may be located at one of the ends of the surge arrestor, for example.

Such a fault-indicator device is designed to show that a current is passing or has passed from the electricity line to ground via the arrestor, i.e. to display the passage of a leakage current through the arrestor.

The Applicant has already described and shown such an indicator device in French patent application number 91 15915 filed Dec. 20, 1991.

That is why the fault-indicator device is not described in greater detail herein.

Nevertheless, it may be observed that such a fault-indicator device preferably comprises:

a bolt centered on the axis 102 of the stack of varistors and electrically connected to one of the contact pieces 200;

a low loss current sensor comprising a coil surrounding the bolt;

an electronic circuit including:

1 a rectifier bridge whose inputs are connected to the coil; and 2 a capacitor connected to the outputs of the rectifier bridge to integrate the energy of the detected leakage current; and an indicator assembly proper, e.g. based on pyrotechnical components, and designed to be fired by the energy integrated in the capacitor.

The arrestor of the present invention provides numerous advantages over previously known arrestors.

Firstly, compared with an envelope that is molded or that is molded over the inner components, making the outer envelope 400 by extrusion provides the major advantage of a very great degree of flexibility and of making it easy and quick to change the parameters of the resulting profile.

Furthermore, the present invention makes it easy to adapt the length of the surge arrestor to the nominal voltage of the line to be protected.

The present invention does not require any kind of mold to be adapted.

The present invention makes it possible to avoid having any layer of air at the interface between the envelope 300 and the envelope 400, consequently making it possible to avoid any surface discharge through such air.

The present invention also makes it possible to greatly reduce the weight and the size of surge arrestors relative to previously known arrestors.

Naturally, the present invention is not limited to the particular embodiment described above, but extends to any variant coming within the spirit of the invention.

We claim:

1. A method of making a surge arrestor comprising the following steps:

i) stacking a stack of varistors;

ii) forming a first envelope of composite material comprising fibers impregnated by a resin on the stack of varistors, said first envelope being at least semi-rigid and having constant outside section over its entire length, to compensate for surface non-uniformities in the stack of varistors due to alignment errors and to dispersions in dimensions of the varistors; and iii) placing an outer envelope having fins on the first envelope made of composite material by:

a) initially extruding an outer envelope of substantially constant thickness over the first envelope; and then b) fitting annular fins to the outer envelope after the outer envelope has been extruded.

2. A method according to claim 1, further including the step of placing contact pieces of electrically conductive material on ends of the stack of varistors prior to step ii).

3. A method according to claim 1, wherein the outer envelope is made of a silicone-based material.

4. A method according to claim 1, wherein the outer envelope is at least 3 mm thick.

5. A method according to claim 1, wherein the fins are fixed on the outer envelope by means of a synthetic adhesive.

6. A method according to claim 1, wherein the envelope of composite material comprises a cloth of fibers extending parallel to a stacking axis of the varistors, and that means are provided for locking the envelope of composite material both in rotation and in translation to contact pieces placed at ends of the stack of varistors.

7. A method according to claim 1, wherein the first envelope is formed by means of an open-mesh fiber cloth.

8. A method according to claim 1, wherein collars are clamped against an end of the outer envelope.

9. A method according to 1, further including a step consisting in placing a keying primary coat on an outside surface of the first envelope prior to extruding the outer envelope over the first envelope.

10. A method according to claim 1, further consisting in fixing a bar centered on an axis of the stack and having the same outside section as the first envelope on at least one of ends of the stack of varistors fitted with the first envelope, prior to extruding the outer envelope over the first envelope.

11. A method according to claim 10 further including a step consisting in placing a keying primary coat on the outside surface of the first envelope prior to subjecting it to the extrusion step, and wherein the keying primary is placed solely on the outside surface of the first envelope but is not disposed on the bar.

12. A surge arrestor comprising:

a stack of varistors;

a first envelope of composite material comprising fibers impregnated by a resin formed on the stack of varistors said first envelope being at least semi-rigid and having constant outside section over its length, to compensate for surface non-uniformities in the stack of varistors due to defects of alignment and to dispersions in dimensions of the varistors; and a finned external envelope placed on the first envelope made of composite material;

the finned external envelope comprising firstly an outer envelope of substantially constant thickness formed by extrusion on the first envelope, and secondly annular fins subsequently installed on the outer envelope after the outer envelope has been extruded.

13. A surge arrestor according to claim 12, further including contact pieces of electrically conductive material on ends of the stack of varistors.

14. A surge arrestor according to claim 12, wherein the outer envelope is made of a silicone-based material.

15. A surge arrestor according to claim 12, wherein the outer envelope is at least 3 mm thick.

16. A surge arrestor according to claim 12, wherein the fins are fixed on the outer envelope by means of a synthetic adhesive.

17. A surge arrestor according to claim 12, wherein the envelope of composite material comprises a cloth of fibers extending parallel to an axis of the stack of varistors and means for locking the envelope of composite material in rotation and in translation on contact pieces placed at ends of the stack of varistors.

18. A surge arrestor according to claim 12, wherein the first envelope is formed by means of an open-mesh fiber cloth.

19. A surge arrestor according to claim 12, wherein collars are clamped on ends of the outer envelope.

20. A surge arrestor according to claim 12, further including caps of electrically conductive material on ends of the arrestor.

21. A surge arrestor according to claim 20, wherein the caps have a larger diameter defined by an edge lying between an outside diameter of the outer envelope and a larger diameter of the fins.

22. A surge arrestor according to claim 12, including a contact piece at each end that has an annular groove designed to receive one end of the envelope of composite material together with a band clamping said envelope in the groove, and a structure that is not circularly symmetrical about an axis of the contact piece.

23. A surge arrestor according to claim 22, wherein the structure that is not circularly symmetrical provided on each contact piece is selected from the group comprising helical threads and an element of polygonal right section.

24. A surge arrestor comprising:

a stack of varistors;

a first envelope of composite material comprising fibers impregnated by a resin formed on the stack of varistors said first envelope being at least semi-rigid and having constant outside section over its length to compensate for surface non-uniformities in the stack of varistors due to defects of alignment and to dispersions in dimensions of the varistors;

a keying primary coat on outside surface of the first envelope, and a finned external envelope placed on the first envelope made of composite material;

the finned external envelope comprising firstly an outer envelope of substantially constant thickness formed by extrusion on the first envelope, and secondly annular fins subsequently installed on the outer envelope after the outer envelope has been extruded.

25. A surge arrestor according to claim 12, including a keying primary coat on an outside surface of the first envelope.

26. A method of making a surge arrestor comprising the following steps:

i) stacking a stack of varistors;

ii) forming a first envelope of composite material comprising fibers impregnated by a resin on the stack of varistors, said first envelope being at least semi-rigid and having constant outside section over its entire length, to compensate for surface non-uniformities in the stack of varistors due to alignment errors and to dispersions in dimensions of the varistors; and iii) placing an outer envelope having fins on the first envelope made of composite material; by a) initially extruding an outer envelope of substantially constant thickness over the first envelope; and then b) fitting annular fins to the outer envelope after the outer envelope has been extruded, wherein the outer envelope is at least 3 mm thick.

27. A method of making a surge arrestor comprising the following steps:

i) stacking a stack of varistors;

ii) forming a first envelope of composite material comprising fibers impregnated by a resin on the stack of varistors, said first envelope impregnated by a resin on the stack of varistors, said first envelope being at least semi-rigid and having constant outside section over its entire length, to compensate for surface non-uniformities in the stack of varistors due to alignment errors and to dispersions in dimensions of the varistors; and iii) placing an outer envelope having fins on the first envelope made of composite material; by a) initially extruding an outer envelope of substantially constant thickness over the first envelope; and then b) fitting annular fins to the outer envelope after the outer envelope has been extruded, and fixing said fins on the outer envelope by means of a synthetic adhesive.

28. A method of making a surge arrestor comprising the following steps:

i) stacking a stack of varistors;

ii) forming a first envelope of composite material comprising fibers impregnated by a resin on the stack of varistors, said first envelope being at least semi-rigid and having constant outside section over its entire length, to compensate for surface non-uniformities in the stack of varistors due to alignment errors and to dispersions in dimensions of the varistors; and iii) placing an outer envelope having fins on the first envelope made of composite material; by a) initially extruding an outer envelope of substantially constant thickness over the first envelope; and then b) fitting annular fins to the outer envelope after the outer envelope has been extruded wherein the envelope of composite material comprises a cloth of fibers extending parallel to a stacking axis of the varistors, and that means are provided suitable for locking the envelope of composite material both in rotation and in translation to contact pieces placed at ends of the stack of varistors.

29. A method of making a surge arrestor comprising the following steps:

i) stacking a stack of varistors;

ii) forming a first envelope of composite material comprising an open-mesh fiber cloth impregnated by a resin on the stack or varistors, said first envelope being at least semi-rigid and having constant outside section over its entire length, to compensate for surface non-uniformities in the stack of varistors due to alignment errors and to dispersions in dimensions of the varistors; and iii) placing an outer envelope having fins on the first envelope made of composite material; by a) initially extruding an outer envelope of substantially constant thickness over the first envelope; and then b) fitting annular fins to the outer envelope after the outer envelope has been extruded.

30. A method of making a surge arrestor comprising the following steps:

i) stacking a stack of varistors;

ii) forming a first envelope of composite material comprising fibers impregnated by a resin on the stack of varistors, said first envelope being at least semi-rigid and having constant outside section over its entire length, to compensate for surface non-uniformities in the stack of varistors due to alignment errors and to dispersions in dimensions of the varistors; and iii) placing an outer envelope having fins on the first envelope made of composite material; by a) placing a keying primary coat on outside surface of the first envelope b) initially extruding an outer envelope of substantially constant thickness over said keying primary coat; and then c) fitting annular fins to the outer envelope after the outer envelope has been extruded.

31. A method of making a surge arrestor comprising the following steps:

i) stacking a stack of varistors;

ii) forming a first envelope of composite material comprising fibers impregnated by a resin on the stack of varistors, said first envelope being at least semi-rigid and having constant outside section over its entire length, to compensate for surface non-uniformities in the stack of varistors due to alignment errors and to dispersions in dimensions of the varistors;

iii) fixing a bar centered on an axis of the stack and having the same outside section as the first envelope on at least one of ends of the stack of varistors fitted with the first envelope, and iv) placing an outer envelope having fins on the first envelope made of composite material; by a) initially extruding an outer envelope of substantially constant thickness over the first envelope; and then b) fitting annular fins to the outer envelope after the outer envelope has been extruded.

32. A method according to claim 31 further including a step consisting in placing a keying primary coat on the outside surface of the first envelope prior to subjecting it to the extrusion step, and wherein the keying primary coat is placed solely on the outside surface of the first envelope but is not disposed on the bar.

33. A surge arrestor comprising:

a stack of varistors;

a first envelope of composite material comprising fibers impregnated by a resin formed on the stack of varistors said first envelope being at least semi-rigid and having constant outside section over its length to compensate for surface non-uniformities in the stack of varistors due to defects of alignment and to dispersions in dimensions of the varistors; and a finned external envelope placed on the first envelope made of composite material; and the finned external envelope comprising firstly an outer envelope of substantially constant thickness formed by extrusion on the first envelope, and secondly annular fins subsequently installed on the outer envelope after the outer envelope has been extruded, wherein the outer envelope is at least 3 mm thick.

34. A surge arrestor comprising:

a stack of varistors;

a first envelope of composite material comprising fibers impregnated by a resin formed on the stack of varistors said first envelope being at least semi-rigid and having constant outside section over its length to compensate for surface non-uniformities in the stack of varistors due to defects of alignment and to dispersions in dimensions of the varistors; and a finned external envelope placed on the first envelope made of composite material; and the finned external envelope comprising firstly an outer envelope of substantially constant thickness formed by extrusion on the first envelope, and secondly annular fins subsequently installed on the outer envelope after the outer envelope has been extruded and fixed on the outer envelope by means of a synthetic adhesive.

35. A surge arrestor comprising:

a stack of varistors;

a first envelope of composite material comprising a cloth of fibers extending parallel to an axis of the stack of varistors impregnated by a resin formed on the stack of varistors said first envelope being at least semi-rigid and having constant outside section over its length to compensate for surface non-uniformities in the stack of varistors due to defects of alignment and to dispersions in dimensions of the varistors;

means are provided suitable for locking the envelope of composite material in rotation and in translation on contact pieces placed at ends of the stack of varistors, and a finned external envelope placed on the first envelope made of composite material; and the finned external envelope comprising firstly an outer envelope of substantially constant thickness formed by extrusion on the first envelope, and secondly annular fins subsequently installed on the outer envelope after the outer envelope has been extruded.

36. A surge arrestor comprising:

a stack of varistors;

a first envelope of composite material comprising an open-mesh fiber cloth impregnated by a resin formed on the stack of varistors said first envelope being at least semi-rigid and having constant outside section over its length to compensate for surface non-uniformities in the stack of varistors due to defects of alignment and to dispersions in dimensions of the varistors; and a finned external envelope placed on the first envelope made of composite material; and the finned external envelope comprising firstly an outer envelope of substantially constant thickness formed by extrusion on the first envelope, and secondly annular fins subsequently installed on the outer envelope after the outer envelope has been extruded.

37. A surge arrestor comprising:

a stack of varistors;

a first envelope of composite material comprising fibers impregnated by a resin formed on the stack of varistors said first envelope being at least semi-rigid and having constant outside section over its length to compensate for surface non-uniformities in the stack of varistors due to defects of alignment and to dispersions in dimensions of the varistors; and a finned external envelope placed on the first envelope made of composite material; and the finned external envelope comprising firstly an outer envelope of substantially constant thickness formed by extrusion on the first envelope, and secondly annular fins subsequently installed on the outer envelope after the outer envelope has been extruded and collars clamped on ends of the outer envelope.

38. A surge arrestor comprising:

a stack of varistors;

a first envelope of composite material comprising fibers impregnated by a resin formed on the stack of varistors said first envelope being at least semi-rigid and having constant outside section over its length to compensate for surface non-uniformities in the stack of varistors due to defects of alignment and to dispersions in dimensions of the varistors; and a finned external envelope placed on the first envelope made of composite material; and the finned external envelope comprising firstly an outer envelope of substantially constant thickness formed by extrusion on the first envelope, and secondly annular fins subsequently installed on the outer envelope after the outer envelope has been extruded and including furthermore a contact piece at each end of said stack of varistors, that has an annular groove designed to receive one end of the envelope of composite material together with a band clamping said envelope in the groove, and a structure that is not circularly symmetrical about the axis of the contact piece.

39. A surge arrestor according to claim 38, wherein the structure that is not circularly symmetrical provided on each contact piece is selected from the group comprising helical threads and an element of polygonal right section.

* * * * *

UNITED STATES PATENT AND TRADEMARK OFFICE

CERTIFICATE OF CORRECTION

PATENT NO. : 5,497,138

DATED : March 5, 1996

INVENTOR(S) : Malpiece et al.

It is certified that errors appear in the above-identified patent and that said Letters Patent is hereby corrected as shown below:

In column 2 at line 30 please delete " resin, " and insert -- resin, e.g. --

In column 6 at line 51 please delete " 100 "

Signed and Sealed this

Twenty-seventh Day of August, 1996

Bruce Lehman

*Attest:*

BRUCE LEHMAN

*Attesting Officer*

*Commissioner of Patents and Trademarks*